US010699836B2

(12) United States Patent
Schekulin et al.

(10) Patent No.: US 10,699,836 B2
(45) Date of Patent: Jun. 30, 2020

(54) INDUCTOR AND ASSOCIATED PRODUCTION METHOD

(75) Inventors: Dirk Schekulin, Arbon (CH); Silvia Gross-Kaeufler, Romanshorn (CH); Chriss Haertsch, Flawil (CH); Thomas Bisig, Romanshorn (CH); Alex Itten, Romanshorn (CH); Piere Cavin, Weinfelden (CH)

(73) Assignee: Schmidhauser AG, Romanshorn (CH)

( * ) Notice: Subject to any disclaimer, the term of this patent is extended or adjusted under 35 U.S.C. 154(b) by 0 days.

(21) Appl. No.: 14/342,450

(22) PCT Filed: Aug. 20, 2012

(86) PCT No.: PCT/EP2012/066205

§ 371 (c)(1),
(2), (4) Date: May 15, 2014

(87) PCT Pub. No.: WO2013/030029

PCT Pub. Date: Mar. 7, 2013

(65) Prior Publication Data

US 2014/0327505 A1 Nov. 6, 2014

(30) Foreign Application Priority Data

Sep. 2, 2011 (DE) ..... 10 2011 082 045

(51) Int. Cl.

| | |
|---|---|
| ***H01F 27/22*** | (2006.01) |
| ***H01F 27/00*** | (2006.01) |
| ***H01F 37/00*** | (2006.01) |
| ***H01F 41/04*** | (2006.01) |
| ***H01F 27/28*** | (2006.01) |
| ***H01F 41/00*** | (2006.01) |

(52) U.S. Cl.
CPC ..... *H01F 27/008* (2013.01); *H01F 27/22* (2013.01); *H01F 27/28* (2013.01); *H01F 37/00* (2013.01); *H01F 41/00* (2013.01); *H01F 41/04* (2013.01); *Y10T 29/4902* (2015.01)

(58) Field of Classification Search
CPC ..... H01F 27/22; H01F 27/027; H01F 27/292; H01F 5/04; H01F 27/2847
USPC ..... 336/55, 61, 65, 83, 192, 221, 223
See application file for complete search history.

(56) References Cited

U.S. PATENT DOCUMENTS 3,244,960 A * 4/1966 Stevens ..... H02M 7/068 336/208
3,428,928 A * 2/1969 Maines ..... H01F 27/323 336/206

(Continued)

FOREIGN PATENT DOCUMENTS

CN 2410721 Y 12/2000
CN 1656577 A 8/2005

(Continued)

OTHER PUBLICATIONS

International Search Report (PCT/ISA/210) with English translation thereof dated Oct. 17, 2012 {Four (4) pages}.

*Primary Examiner* — Tszfung J Chan
(74) *Attorney, Agent, or Firm* — Crowell & Moring LLP

(57) ABSTRACT

An inductor includes a magnetizable core with a winding axis and at least one winding. The winding is formed by a conductor which at least partly surrounds the winding axis of the core. The winding is formed in one layer and a cross section of the conductor is rectangular, in particular square.

11 Claims, 1 Drawing Sheet

(56) References Cited

U.S. PATENT DOCUMENTS 4,577,175 A * 3/1986 Burgher ..... H01F 27/2876 336/183
4,641,115 A * 2/1987 Bailey ..... H03H 1/0007 323/353
4,833,437 A * 5/1989 Williamson ..... H01F 27/2852 336/192
4,874,916 A * 10/1989 Burke ..... H05B 6/02 219/632
5,210,513 A * 5/1993 Khan ..... H01F 27/22 336/233
6,087,916 A * 7/2000 Kutkut ..... H01F 27/22 336/195
6,518,868 B1 * 2/2003 Miller ..... G06F 1/20 336/55
6,879,235 B2 * 4/2005 Ichikawa ..... H01F 27/306 336/200
6,927,667 B1 * 8/2005 Busletta ..... H01F 17/045 336/180
2004/0125628 A1 7/2004 Yamada et al.
2004/0135660 A1 7/2004 Holdahl et al.
2006/0139140 A1 * 6/2006 Weng ..... H01F 27/255 336/208
2007/0027353 A1 * 2/2007 Ghiron ..... A61N 2/02 600/9
2009/0144967 A1 * 6/2009 Hasu ..... H01F 27/2847 29/605
2009/0201648 A1 * 8/2009 Ganev ..... H05K 7/209 361/707
2010/0194517 A1 8/2010 Karasek et al.
2010/0209314 A1 * 8/2010 Sato ..... H01F 37/00 422/198
2011/0032068 A1 * 2/2011 Ikriannikov ..... H01F 3/10 336/221
2011/0279212 A1 * 11/2011 Ikriannikov ..... H01F 17/0006 336/192

FOREIGN PATENT DOCUMENTS

CN 1839450 A 9/2006
CN 101689420 A 3/2010
CN 101772813 A 7/2010
CN 101807476 A 8/2010
CN 201673764 U * 12/2010
CN 201673764 U * 12/2010
DE 197 23 958 A1 12/1998
DE 10 2007 036 052 A1 2/2009
EP 0 883 144 A2 12/1998
EP 0 883 144 A3 12/1998
JP 60077409 A * 5/1985
JP 02044704 A * 2/1990
WO WO 2009/059069 A2 5/2009

* cited by examiner

INDUCTOR AND ASSOCIATED PRODUCTION METHOD

BACKGROUND AND SUMMARY OF THE INVENTION

The invention relates to an inductor and an associated production method.

Inductors or storage inductors are preferably used for the integration of clocked voltage signals, for example in DC choppers. In particular with high medium currents with significant current ripple, considerable problems are encountered in respect of losses and cooling of the winding.

Conventional windings of storage inductors are formed, for example, from layered laminated constructions, flat-wire edge windings and copper strip windings. Materials formed from ferrite, amorphous metallic glass, nanocrystalline strips or metal powders are used as core materials.

All of the above-mentioned solutions have the common problem of efficient cooling of the inductor. For example, defined cooling by use of a plate through which a cooling medium flows is typically necessary in a closed housing.

In the case of inductive components however, the heat is generally produced in a volume, such that complex cooling concepts are generally necessary.

The object of the invention is to provide an inductor and an associated production method which enable efficient cooling of the inductor with the lowest possible outlay.

The invention achieves this object by an inductor comprising a magnetizable core having a winding axis, and at least one winding, which is formed by a conductor which at least partly surrounds the winding axis of the core. The at least one winding is formed in one layer and a cross section of the conductor is rectangular, in particular square. The invention further achieves this object by a production method for the above inductor wherein the winding is formed from a profiled tube, which is structured to form the conductor.

The inductor, in particular in the form of what is known as a storage inductor or high-current inductor, has a magnetic or magnetizable core, which defines a winding axis or has a winding axis, and at least one winding, which is formed by a conductor which at least partly surrounds, in particular at the shortest possible distance, the at least one winding axis of the core or a limb of the core, through which the at least one winding axis runs. The at least one winding is formed in one layer, that is to say windings formed by the conductor run only adjacently and are not layered. A cross section of the conductor in the winding direction is rectangular, in particular square. Due to the cross section and the resultant outer contour, the winding can be coupled very easily and with low thermal resistance to a cooling surface for example. The cross section of the winding, which is solid in particular, or of the solid conductor, is intentionally overdimensioned here, such that an efficient heat flow is possible within the winding.

In accordance with the invention, the inductor has a magnetic or magnetizable core, at which heat dissipation occurs significantly via the winding coupled thermally to the core. Due to the selection of a large solid conductor cross section or winding cross section, a sufficient heat flow and, therefore, heat dissipation is made possible, for example via a plate cooled by water on one side.

In an embodiment the conductor solid, that is to say the entire cross section of the conductor is filled with conductor material, or the conductor, is filled completely with conductor material within its outer dimension. The conductor in particular is not constructed by interwoven stranded wires, a plurality of combined individual conductors, or in the form of a hollow conductor or the like.

In an embodiment the at least one winding is formed from a profiled tube, in particular a rectangular profiled tube. The profiled tube is structured to form the conductor, in particular is structured by material removing machining, in particular is structured by drilling, sawing, milling and/or electric discharge machining. Alternatively, the at least one winding is formed from a diecast shaped article.

In an embodiment the inductor has a nominal current-carrying capacity, wherein the cross section of the conductor is dimensioned in such a way that a current-carrying capacity of the conductor is greater than the nominal current-carrying capacity, that is to say the cross section of the conductor is overdimensioned in relation to the nominal current-carrying capacity. In addition or alternatively, the winding and the core can be dimensioned in such a way that, if the inductor is loaded by its nominal current-carrying capacity, the winding losses are greater than the core losses, such that efficient cooling can be ensured on the whole due to the optimized ability to cool the winding.

In an embodiment the conductor consists of copper or titanium, particularly preferably of aluminum.

In an embodiment a planar cooling element is provided, which is thermally coupled to the winding, in particular to the side or surface of the winding facing away from the winding axis of the core. A heat-conductive electric insulator is preferably provided and is arranged between the cooling element and the winding. The electric insulator is preferably an electrically insulating heat-conductive foil.

In an embodiment the winding forms a heat sink.

In an embodiment a distance between the winding and the core is selected in such a way that losses caused by leakage fields are minimized.

In the method for producing the above-mentioned inductor, the winding is formed from a profiled tube, in particular from a rectangular profiled tube, which is structured to form the conductor, in particular as a result of material removing machining in the form of drilling, sawing, milling and/or electric discharge machining of the profiled tube.

The invention will be described hereinafter with reference to the drawings, which illustrate preferred embodiments.

DETAILED DESCRIPTION OF THE DRAWINGS

Figure 1:
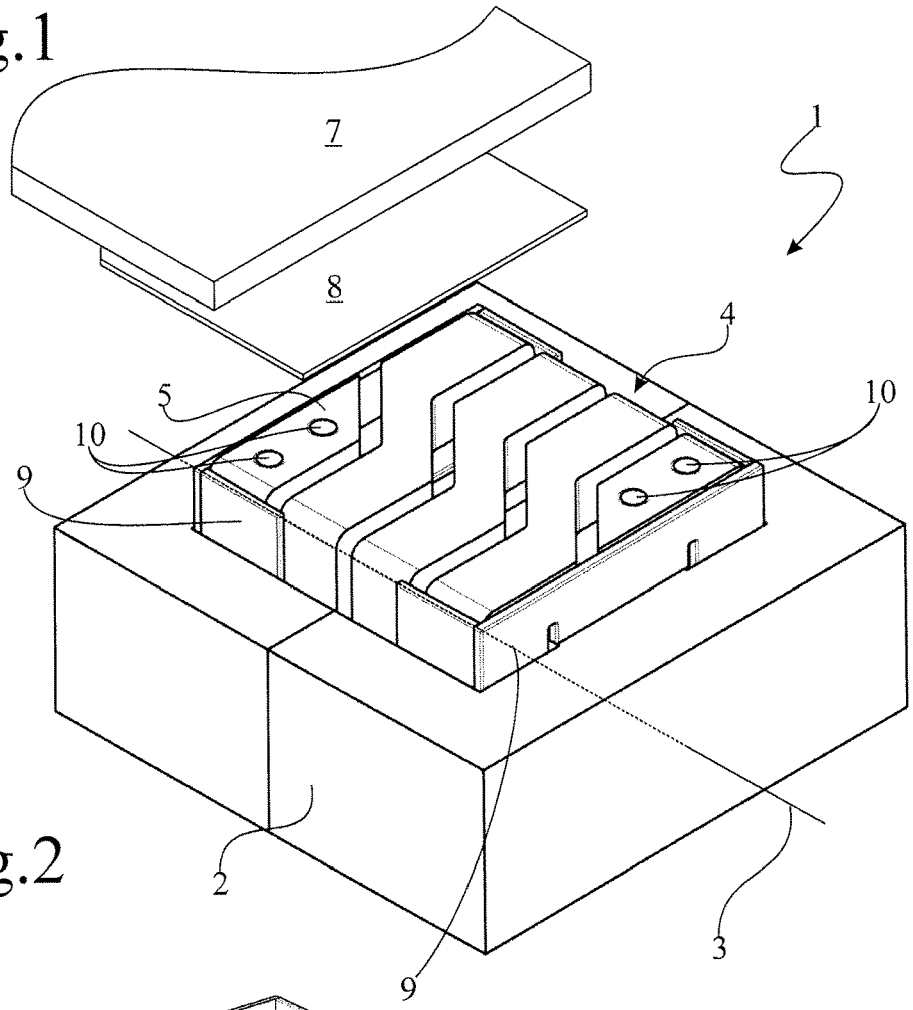
FIG. 1 shows schematically an illustration of an inductor according to the invention with cooling element.

FIG. 1 shows a storage inductor 1 for high currents, for example 200 amps or more. The storage inductor 1 has an E-I-shaped magnetizable core 2, for example made of ferrite, amorphous metallic glass, nanocrystalline strips or metal powders as core material, having a limb that defines a winding axis 3, and has a one-layer winding 4, which is formed by a solid conductor 5 made of aluminum with rectangular cross section. The winding 4 annularly surrounds the winding axis 3 of the core 2.

The inductor 1 has a nominal current-carrying capacity of, nominally, 200 A of medium current, wherein the cross section of the conductor 5 is dimensioned in such a way that it can conduct more than the nominal current. The winding 4 and the core 2 are dimensioned in such a way that, if the inductor 1 is loaded by the nominal current, winding losses are greater than core losses, such that the heat produced during operation can be easily removed by cooling the winding 4, which can be implemented much more easily than a cooling of the core 2.

For efficient cooling, a planar cooling element 7 is further provided, which is to be thermally coupled to the side or surface of the winding 4 facing away from the winding axis 3 of the core 2. A heat-conductive electric insulator in the form of an electrically insulating heat-conductive foil 8 is provided between the cooling element 7 and the winding 4. Corresponding cooling elements can be provided on the upper face and/or the lower face of the winding 4.

A distance between the limb of the core 2 and the surface of the winding 4 facing the limb is fixed to be small by use of a spacer 9 in such a way that leakages are minimized.

The cross section of the conductor 5 is dimensioned in such a way that, at an intended working frequency of the inductor 1, the effective replacement area due to the skin effect is much smaller than the cross section of the solid conductor 5. The dominating alternating current loss thus flows in the outer region of the conductor 5 or winding 4 in the direction of the core region of the winding 4 and lastly along the winding 4 to the heat sink in the form of the cooling element 7.

Bores 10 serve as connection elements for further parts (not shown) of a circuit that uses the inductor 1.

Figure 2:
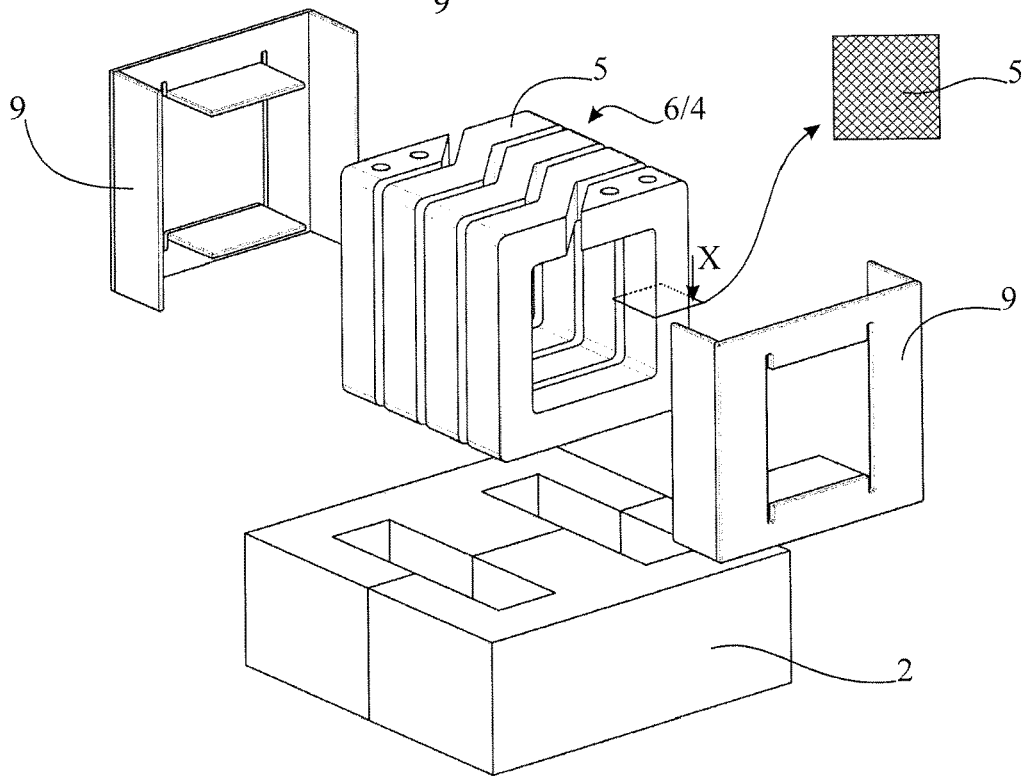
FIG. 2 shows schematically an exploded illustration of the inductor shown in FIG. 1.

FIG. 2, for clarification, shows an exploded illustration of the inductor 1 shown in FIG. 1.

A rectangular profiled tube 6, which is illustrated in the form in which it has already been structured or machined, is structured to form the winding 4 or the conductor 5.

The structuring occurs by helical milling to form the winding 4 or the conductor 5, wherein individual winding segments are produced by cutting in the transverse direction of the profiled tube 6 and each form a respective coil together with an associated core and the further illustrated components. The connection points 10 are produced by drilling.

When produced in very high numbers, the winding 4 may, alternatively, be formed from a diecast shaped article.

In accordance with the invention a solid winding 4 is provided, which has square or rectangular outer dimensions. The winding 4 can therefore be coupled very easily and with low thermal resistance to a cooling surface 7. The cross section of the solid winding 4 is intentionally overdimensioned here, such that an efficient heat flow is possible within the winding 4, that is to say the winding 4 is simultaneously the inner heat sink of the component 1.

The electrical insulation of the winding 4 with respect to the cooling plate or the heat sink 7 is achieved by a thin heat-conductive foil 8 or ceramic material.

The material of the winding 4 is aluminum, copper or titanium.

The highly efficient ability to cool the coil or the component 1 via the solid winding 4, which can be effectively thermally coupled, is advantageous. Furthermore, aluminum can be used as a conductor material due to the large cross section, whereby weight and costs are saved.

The inductor 1 according to the invention has a solid winding, of which the cross section is dimensioned in such a way that transport of the produced heat loss to a planar heat sink 7 is possible, and therefore complex cooling measures can be omitted.

Instead of the illustrated E-I-shaped core 2, a differently shaped core can, of course, be used, for example a U-shaped core having two externally arranged windings.

The invention claimed is:

1. An inductor, comprising:

a magnetizable core having a single winding axis;

at least one winding, the winding being formed by a conductor at least partly surrounding the single winding axis of the core;

a planar cooling element thermally coupled to a side of the winding facing away from the single winding axis of the core without a thermally insulating material between the planar cooling element and the side of the winding, and spacers at opposite axial ends of the winding, the spacers each including at least two projections aligned parallel to the single winding axis that are configured to fix a distance between the core and the winding in a direction transverse to the single winding axis, wherein the conductor is formed in one layer from a profiled tube, the profiled tube being formed with a continuous spiral gap in a wall of the profiled tube such that the conductor has a rectangular coil shape, the side of the winding thermally coupled to the planar cooling element is planar, a side of the planar cooling element thermally coupled to the winding is planar, the winding and the core are dimensioned such that, when the inductor is loaded by current, heat generated by winding losses is greater than heat generated by core losses, the inductor has a nominal current-carrying capacity, the cross-section of the conductor is dimensioned such that a current-carrying capacity of the conductor is greater than the nominal current-carrying capacity of the inductor, and the winding and the core are dimensioned such that, when the inductor is loaded by the nominal current-carrying capacity of the inductor, winding losses are greater than core losses.

2. The inductor according to claim 1, wherein the cross-section of the conductor is square.

3. The inductor according to claim 1, wherein the conductor is solid.

4. The inductor according to claim 1, wherein the winding is formed from a profiled tube, the profiled tube being structured to form the conductor.

5. The inductor according to claim 4, wherein the structuring of the profiled tube to form the conductor is carried out by at least one of drilling, cutting, milling or electric discharge machining.

6. The inductor according to claim 1, wherein the winding is formed from a diecast shaped article.

7. The inductor according to claim 1, wherein the conductor is formed of aluminum, copper or titanium.

8. The inductor according to claim 1, further comprising:

a heat-conductive electric insulator arranged between the planar cooling element and the winding.

9. The inductor according to claim 8, wherein the heat-conductive electric insulator is an electrically insulating heat-conductive foil.

10. The inductor according to claim 1, wherein the winding is a heat sink configured to receive heat from the core.

11. The inductor according to claim 1, wherein a distance between the winding and the core is such that losses caused by leakage fields are minimized.

* * * * *